United States Patent [19]

Bennett

[11] Patent Number: 5,064,103

[45] Date of Patent: Nov. 12, 1991

[54] FOAM DISPENSER HAVING A PLURALITY OF SIEVES

[75] Inventor: Robert A. Bennett, Easton, Conn.

[73] Assignee: RJS Industries, Inc., Marlboro, N.J.

[21] Appl. No.: 527,431

[22] Filed: May 23, 1990

[51] Int. Cl.[5] ..... B67D 5/00

[52] U.S. Cl. ..... 222/190; 222/211; 239/327; 239/343

[58] Field of Search ..... 222/190, 211, 206, 189; 239/327, 343, 590.5

[56] References Cited

U.S. PATENT DOCUMENTS

| | | | |
|---|---|---|---|
| 2,577,025 | 12/1951 | Lundberg | 239/343 |
| 2,651,546 | 9/1953 | Palm | 239/343 |
| 2,715,045 | 8/1955 | Thompson | 239/343 |
| 3,422,993 | 1/1969 | Boehm et al. | 222/190 |
| 4,219,159 | 8/1980 | Wesner | 239/343 |
| 4,730,786 | 3/1988 | Nelson | 239/590.5 |
| 4,932,567 | 6/1990 | Tanabe et al. | 222/190 |

FOREIGN PATENT DOCUMENTS

| | | | |
|---|---|---|---|
| 0268733 | 12/1965 | Australia | 239/343 |
| 0163409 | 5/1958 | Sweden | 239/343 |

*Primary Examiner*—Michael S. Huppert
*Assistant Examiner*—Anthoula Pomrening

[57] ABSTRACT

A foam dispenser includes an elongated squeezable relatively small vertical container having a top disposed open neck and being otherwise sealed. An elongated vertical member has hollow upper and lower sections which communicate with each other. The upper end of the upper section has a relatively large opening. The lower section has a relatively small opening. The member is sealed in the neck with the large opening disposed above the neck and constituting a discharge orifice. At least two vertically spaced horizontal sieves are sealed one below the other in the orifice. The upper one of the sieves is a fine sieve, the lower one of the sieves is a coarser sieve.

5 Claims, 1 Drawing Sheet

FOAM DISPENSER HAVING A PLURALITY OF SIEVES

BACKGROUND OF THE INVENTION

Foam dispensers typically employ a deformable reservoir of foamable fluid and air, discharge means with a discharge orifice, and foam producing means which includes both a foam overlay or filter and a check valve. The foam producing means has some type of well with air passages which form a mixing chamber. When the reservoir is squeezed, the liquid and air are mixed in the chamber. The mixture is passed through the overlay to produce a foam which is discharged through the discharge orifice. Known dispensers have one or more openings spaced from the discharge orifice to permit replacement air to flow back into the reservoir during and/or after discharge to recharge the dispenser with air so that subsequent discharges can take place. The check valve controls the flow of liquid and/or air in order to prevent the dispenser from being clogged or jammed during or after discharge.

The present invention is directed toward a new type of foam dispenser which eliminates the check valve and also eliminates any air openings spaced from the discharge orifice, thus producing a dispenser which uses fewer parts and can be more easily assembled and, therefore, can be produced and sold at a much lower cost.

SUMMARY OF THE INVENTION

Accordingly, it is an object of the present invention to provide a new and improved foam dispenser which does not utilize a check valve.

Another object is to provide a new and improved foam dispenser which eliminates the need for any air openings spaced from the discharge orifice by using the orifice itself for flow of replacement air.

Still another object is to provide a new and improved foam dispenser wherein the mixing action is produced by shaking the container rather then by using a well with air passages.

These and other objects and advantages of the invention will either be explained or will become apparent hereinafter.

In accordance with the principles of the invention, the foam dispenser is provided with an elongated squeezable relatively small vertical container having a top disposed open neck and being otherwise sealed. An elongated vertical member has hollow upper and lower sections which communicate with each other. The upper end of the upper section has a relatively large opening while the lower section has a relatively small opening. The member is sealed in the neck with the large opening disposed above the neck. The large opening constitutes a discharge orifice. At least two vertically spaced horizontal sieves are sealed one below the other in the discharge orifice, the upper one of the sieves being a fine sieve, the lower one of the sieves being a coarser sieve.

In use, the container is filled to a vertical level which is less than half the vertical height of the container with a liquid having a density similar to that of water. The container is vigorously shaken. When the container is held upright and squeezed, foam is discharged through the orifice. After discharge, air is returned to the interior of the container via the orifice.

When the liquid is very dense, for example a liquid hand soap, it is necessary to add two additional sieves spaced one below the other and below the lower one of the original two sieves, with the upper one of the additional sieves being a coarser sieve than the original lower one, and the lower one of the additional sieves being a still coarser sieve than the upper one of the additional sieves.

For liquid densities intermediate a water like density and the very dense liquid, one of the two additional sieves should be eliminated.

If the container is not a relatively small elongated squeezable container, the device will not produce suitable foam. Best results are obtained using containers ranging from two ounces to six ounces capacity. An eight ounce container has been found to be too large.

If the container is filled to a liquid level appreciably above half of the vertical height of the container, the device will not produce suitable foam, even if the container is otherwise small enough. Best results are obtained using a liquid level of about one third the vertical height of the container.

The sieves should all have essentially the same size and shape. To this end, the upper section can have a cylindrical shape. To provide a smooth transition which will not adversely affect the production of foam, the lower section can have the shape of an inverted truncated cone with a horizontal surface in place of an apex. The relatively small opening is disposed in this surface.

The dispenser thus far described will not produce foam when inverted. However, when a dip tube is incorporated into the structure, the dispenser will produce foam when held in any position. To this end, a hollow dip tube open at both ends is disposed in the container. The lower section is provided with means which extend below the relatively small opening which receives and supports the upper end of the dip tube with the opening in the upper end communicating with the relatively small opening.

When the dispenser is not in use, a removable cap engages the outer surface of the neck and seals off the discharge orifice.

DETAILED DESCRIPTION OF PREFERRED EMBODIMENTS

Figure 1:
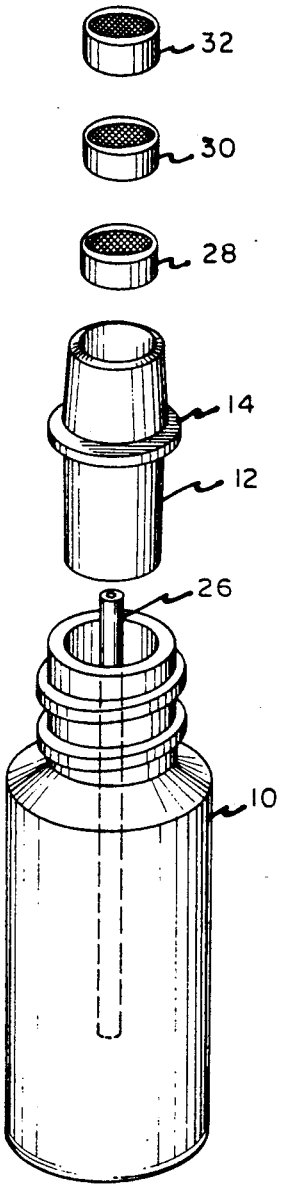
FIG. 1 is an exploded view of a preferred embodiment of the invention.
Figure 3:
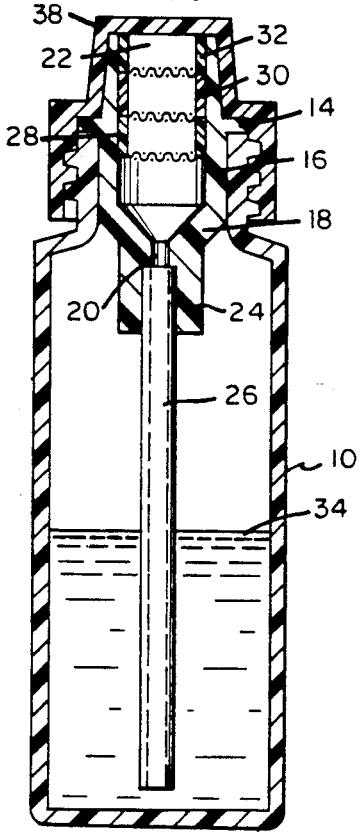
FIG. 3 shows the embodiment of FIG. 1 assembled and in vertical cross section.
Figure 2:
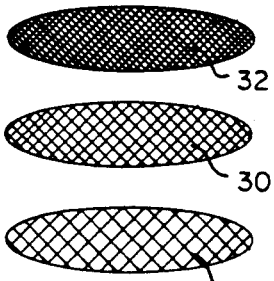
FIG. 2 is a detail view of the sieves used in the structure shown in FIG. 1.

Referring first to FIGS. 1–3, a vertical hollow plastic squeezable container 10, typically of two to three ounce size, has an open neck and is otherwise sealed. A hollow plastic member 12, open at both ends, has a horizontal external lip or ring 14 disposed intermediate the ends. The member is inserted into the neck until the ring engages the top of the neck and then is sealed therein.

The member has hollow upper and lower sections 16 and 18 which communicate with each other, the upper end of the upper section having a relatively large opening, the lower section having a relatively small opening 20. The opening in the upper section is disposed above the neck, and constitutes a discharge orifice 22. The upper section has a cylindrical shape and the lower section has the shape of an inverted truncated cone with a horizontal surface in place of an apex, the relatively small opening being disposed in said surface. The lower section has a portion 24 disposed below the relatively small opening and adapted to receive the upper open end of a hollow vertical dip tube 26 disposed in the container. The dip tube has a lower open end.

The container has a liquid fill 34 which has a level of no more than one half the vertical height of the container. The liquid has a moderate density more than a water-like density and less than relatively high density of a liquid hand soap.

Figure 6:
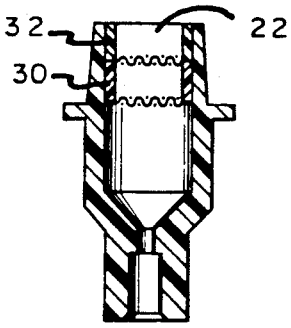
FIG. 6 shows a modified form of sieve structure.
Figure 7:
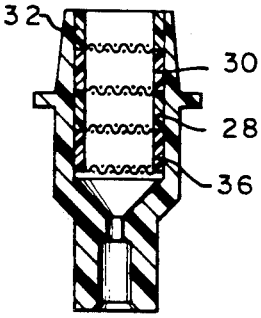
FIG. 7 shows another modified form of sieve structure.

Three horizontal plastic sieves or screens 28, 30 and 32 are disposed one below the other in the discharge orifice of the upper section. The lowest sieve 28 passes droplets having a maximum size of fifty microns. The middle sieve 30 passes droplets having a maximum size of forty microns. The highest sieve 32 passes droplets having a maximum size of thirty microns. When the liquid fill has a water like density, sieve 28 can be eliminated as shown in FIG. 6. When a relatively high density liquid is used, another horizontal sieve 36 can be added and spaced below the three sieves 28, 30 and 32 in the discharge orifice as shown in FIG. 7. Sieve 36 passes droplets having a maximum size of 55 microns.

When not in use, a removable plastic cap 38 is screwed onto the neck to seal the orifice.

Figure 4:
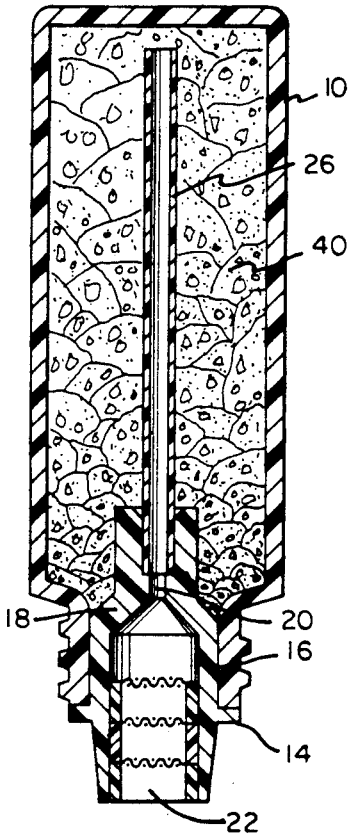
FIGS. 4 and 5 illustrate in vertical cross sectional view, several steps in obtaining a foam discharge from the invention.
Figure 5:
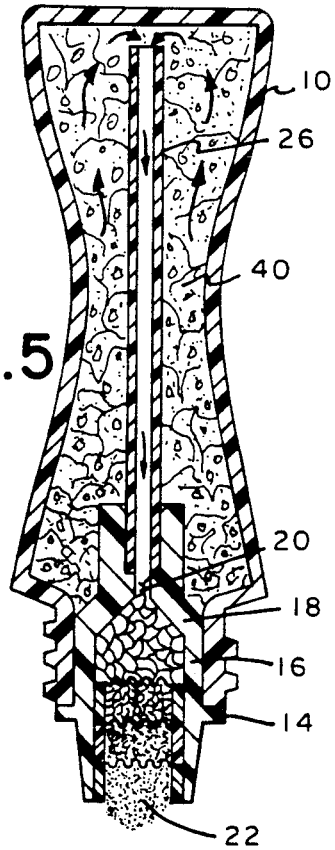

In order to use the dispenser, the container is shaken vigorously until the liquid is mixed with the air in the container to form droplets 40 as shown in FIG. 4. The cap is then removed and the container is squeezed as shown in FIG. 5, thus discharging foam through the orifice. The droplets are squeezed and reduced in size as they pass through the sieves.

Once the discharge has taken place, the replacement air flows into the container through the orifice and sieves. The sieves reduce the velocity of the return air to a value at which turbulence will not cause undesired explusion of liquid or droplets.

While the invention has been described with particular reference to the drawings and preferred embodiments, the protection sought is to be limited only by the terms of the claims which follow.

What is claimed is:

1. A foam dispenser comprising:

an elongated squeezable relatively small vertical container containing liquid, the container having a top disposed open neck and being otherwise sealed;

a vertical hollow dip tube open at both ends and disposed in the container, the lower end of the tube extending into said liquid;

an elongated vertical member having hollow upper and lower sections which communicate with each other, the upper section having a cylindrical shape with an upper end having a relatively large opening constituting a discharge orifice, the lower section having the shape of an inverted truncated cone with a lower horizontal surface in place of an apex, the horizontal surface having a relatively small opening, the lower section having means below the relatively small opening for receiving the upper and of said dip tube, the upper end of the tube communicating with the relatively small opening, the member being sealed in the neck with the large opening disposed above the neck; and at least two vertically spaced horizontal sieves being sealed one below the other in the orifice, the upper one of the sieves being a fine sieve, the lower one of the sieves being a coarser sieve, the number of sieves increasing with increasing density of the liquid.

2. The dispenser of claim 1 further including a third horizontal sieve spaced below said lower one of the sieves in the orifice, the third sieve being coarser than the lower one of the sieves.

3. The dispenser of claim 2 further including a fourth horizontal sieve spaced below the third sieve in the orifice, the fourth sieve being coaser than the third sieve.

4. The dispenser of claim 1 wherein the member has an external horizontal lip which engages and is sealed to the top of the neck.

5. The dispenser of claim 1 further including a removable cap engaging the outer surface of the neck and enclosing the discharge orifice.

* * * * *